US009340861B2

(12) United States Patent
Dubois et al.

(10) Patent No.: US 9,340,861 B2
(45) Date of Patent: May 17, 2016

(54) DOUBLE BEAM FOR SINK ROLL

(71) Applicant: Cockerill Maintenance & Ingénierie S.A., Seraing (BE)

(72) Inventors: Michel Dubois, Boncelles (BE); Brice Van Houtte, Embourg (BE)

(73) Assignee: Cockerill Maintenance & Ingénierie S.A., Seraing (BE)

( * ) Notice: Subject to any disclaimer, the term of this patent is extended or adjusted under 35 U.S.C. 154(b) by 0 days.

(21) Appl. No.: 14/380,287

(22) PCT Filed: Feb. 13, 2013

(86) PCT No.: PCT/EP2013/052885
§ 371 (c)(1),
(2) Date: Aug. 21, 2014

(87) PCT Pub. No.: WO2013/124195
PCT Pub. Date: Aug. 29, 2013

(65) Prior Publication Data

US 2015/0034004 A1 Feb. 5, 2015

(30) Foreign Application Priority Data

Feb. 21, 2012 (EP) ..... 12156293

(51) Int. Cl.
*B05C 3/00* (2006.01)
*C23C 2/40* (2006.01)
*C23C 2/00* (2006.01)
*B05C 3/10* (2006.01)
*B05C 3/12* (2006.01)

(52) U.S. Cl.
CPC ... *C23C 2/40* (2013.01); *B05C 3/10* (2013.01); *B05C 3/125* (2013.01); *C23C 2/003* (2013.01)

(58) Field of Classification Search
None
See application file for complete search history.

(56) References Cited

U.S. PATENT DOCUMENTS 3,643,627 A * 2/1972 Killin et al. ..... 118/421
5,876,661 A * 3/1999 Bachy ..... 266/44
2011/0119905 A1* 5/2011 Bourgier et al. ..... 29/724

* cited by examiner

*Primary Examiner* — Binu Thomas
(74) *Attorney, Agent, or Firm* — Reinhart Boerner Van Deuren P.C.

(57) ABSTRACT

The present invention relates to an installation for the hot-dip coating of a metal strip (11) with a liquid metal, comprising a pot (4) containing a bath of liquid metal, an immersed sink roll (1) for deflecting the strip entering the bath to a vertical exit path and at least one additional roll (2, 3) for controlling the strip flatness, the axes of said sink and additional rolls (1, 2, 3) being supported by arms (16) connected to a main metal frame (8, 8A) itself connected to a base on each side of the pot by means of supports (9, 10), characterized in that the metal frame is a double beam made of a removable beam (8A) connected to an intermediate beam (13) itself anchored to the base by the supports (9, 10).

5 Claims, 3 Drawing Sheets

DOUBLE BEAM FOR SINK ROLL

FIELD OF THE INVENTION

The invention relates to the immersed equipment used in hot-dip galvanization, which function is to deflect into the vertical direction a metal strip such as a steel strip coming from a furnace, after its diving in the pot of molten metal such as molten zinc.

BACKGROUND OF THE INVENTION

A typical pass line in a hot-dip galvanization line is represented on FIG. 1. An immersed roll 1, called a sink roll, is used to deflect the strip 11 coming from the furnace 17 to the vertical pass up to a roll 5, called a top roll. Additional rolls 2, 3 are usually used to improve the strip flatness in front of the gas wiping nozzle 6.

FIG. 2 is a front view of the pot hardware viewed from the sheet plane to the entry area of the strip in the pot. The pot 4 contains the liquid metal used to coat the strip. This pot typically has a volume of 24 to 35 $m^3$ and is lined with ceramic bricks 7 which do not suffer from corrosion by the liquid metal.

According to prior art, these immersed rolls are supported by a metal frame 8, which is most of the time made of stainless steel for the submerged parts. If sink roll 1 is always used, the additional roll 3 is sometimes not used and does not always exist on all the equipments. Frame 8 supporting all the rolls must be fixed in the concrete next to the ceramic bricks assembly 7 to avoid any damage on the pot 4 while having a very high stiffness and resistance to sustain the high strip tension going up to 10 tons.

The roll length is always higher that the maximum width of the strip galvanized. Therefore, the length of the barrel is usually higher than 2 meter and the distance, between the two points 9, 10 anchored in a concrete base, higher than 5 meters. The whole frame 8 is thus very large and difficult to handle and store in the maintenance shop.

Document US 2011/0119905 A1 discloses a device for installing at least one roller in a liquid zinc bath in a galvanizing line used for the galvanization of a continuously-moving steel strip having a beam to which a first pair of arms is attached. The first pair of arms bears a bottom roller. The bottom roller is intended to be submerged in the liquid zinc bath towards a bottom roller operation position, relative to the naturally submerged position of the bottom roller, by way of a movement provided together with a first cylindrical bearing attached to each of the two ends of the beam and supporting the first pair of arms. A second cylindrical bearing is attached to each of the two ends of the beam and separate from the first cylindrical bearing on the same beam end section. A push device interacts with at least one of the first and second cylindrical bearings such that, in the operation position, the first and second cylindrical bearings are maintained in a single predetermined plane and such that the first cylindrical bearing is disposed under the second cylindrical bearing at a minimum supporting height along a vertical plane.

AIMS OF THE INVENTION

The present invention aims at avoiding the drawbacks of prior art.

In particular the invention aims at providing a new system that allows using a main frame, for supporting the submerged rolls in a pot containing a liquid metal, which is much smaller and much lighter than in the prior art configuration.

A goal of the invention is also to implement a support system which can be easily handled, adjusted or dismantled for maintenance purposes.

SUMMARY OF THE INVENTION

The present invention relates to an installation for the hot-dip coating of a metal strip with a liquid metal, comprising a pot containing a bath of liquid metal, an immersed sink roll for deflecting the strip entering the bath to a vertical exit path and at least one additional roll for controlling the strip flatness, the axes of said sink and additional rolls being supported by arms connected to a main metal frame itself connected to a base on each side of the pot by means of supports, characterised in that the metal frame is a double beam made of a removable beam connected to an intermediate beam itself anchored to the base by the supports.

According to preferred embodiments, the installation according to the invention is further limited by one or a suitable combination of the following characteristics:

- the intermediate beam is permanent;
- the intermediate beam is removable for special maintenance purposes;
- the intermediate beam is non-removable and tiltable, rotary or translatable;
- the removable beam makes a unique part with the arms and the rolls;
- the removable beam is connected to the intermediate beam by quick connectors;
- the quick connectors are bolts or air cylinders;
- the quick connectors are clamping means;
- the installation is provided with positioning means of the removable beam, said positioning means being able to adjust the position of the rolls relative to the strip, in the pot;
- the base is a concrete base.

SHORT DESCRIPTION OF THE DRAWINGS

DETAILED DESCRIPTION OF THE INVENTION AND PREFERRED EMBODIMENTS

Figure 5:
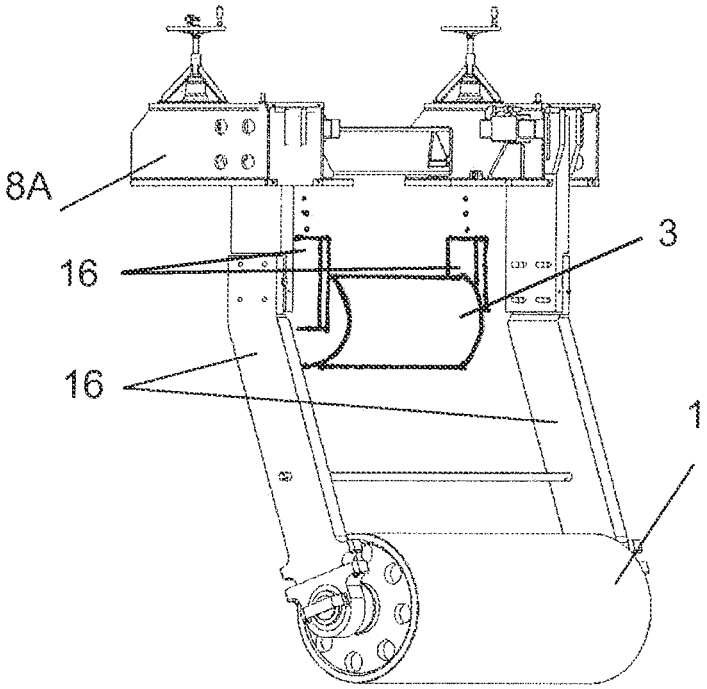
FIG. 5 is a perspective view of the assembly according to the present invention in the case of 2-pot rolls.

The invention consists in a new system that allows to use a much smaller main frame for supporting the submerged rolls 1, 2 and/or 3 in a pot 4 containing a liquid like a liquid metal (FIG. 5).

Because of that arrangement, both the size and the weight of the device comprising the (re)movable beam 8A (referred to herein as removable beam 8A), the arms 16 and the rolls 1, 2, 3, respectively, are much smaller.

Figure 1:
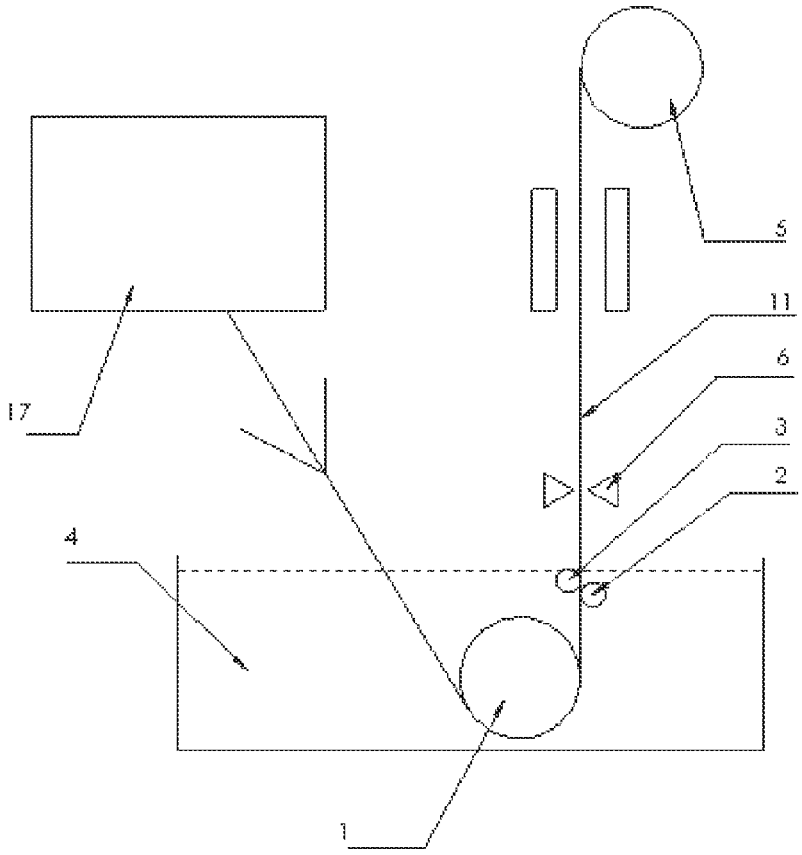
FIG.1 PRIOR ART
FIG. 1 is a schematic cross section of a typical galvanization pot installation.
Figure 2:
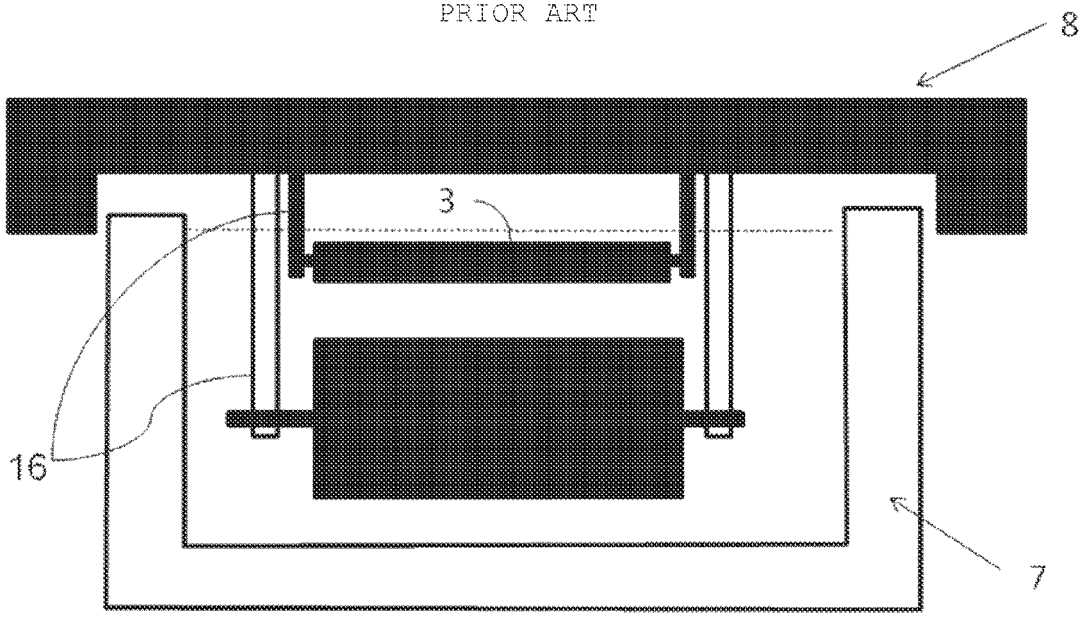
FIG.2 PRIOR ART
FIG. 2 is a schematic front view of the pot hardware. It shows the prior art solution used for supporting the rolls in the bath.
Figure 4:
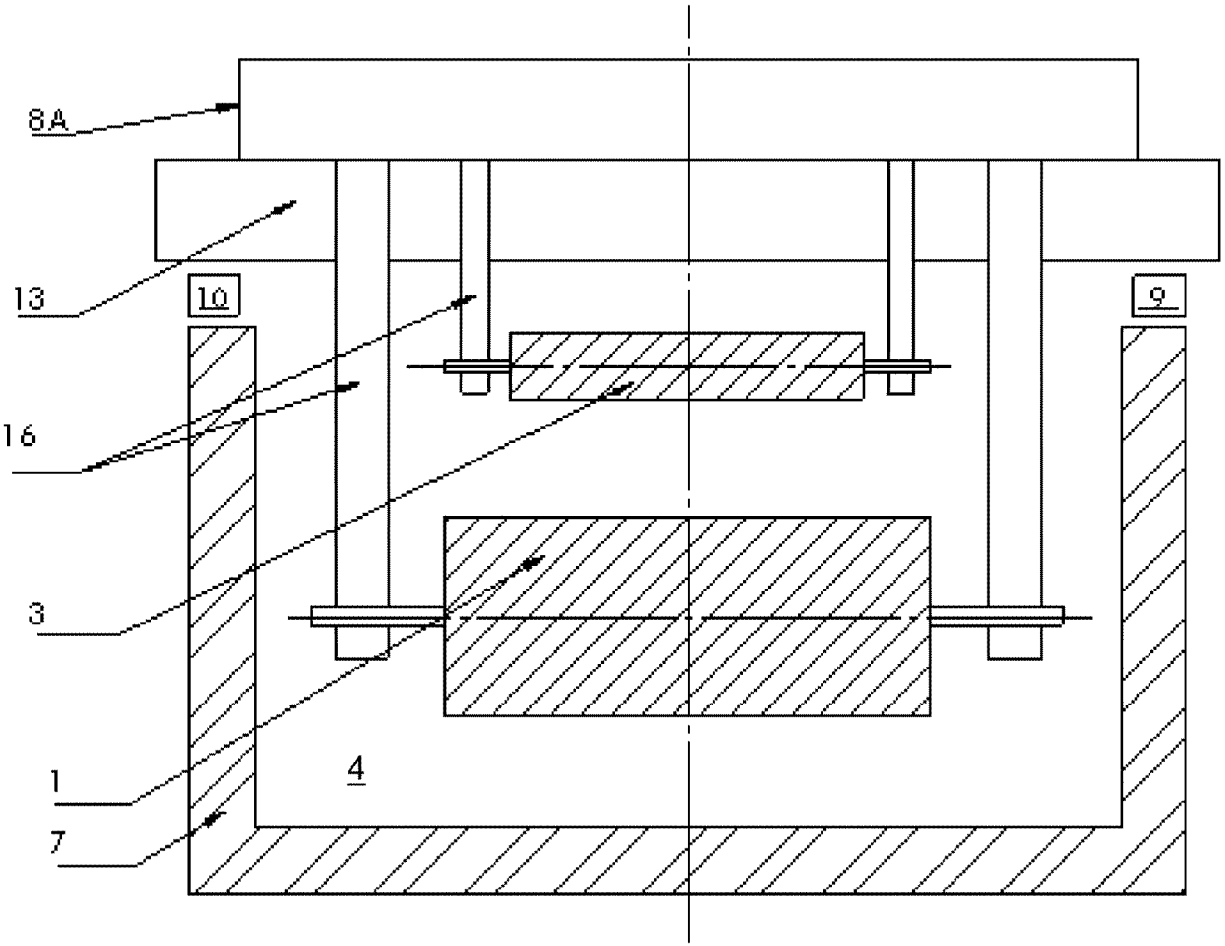
FIG. 4 is a schematic representation of the new solution according to the present invention, wherein the main beam is much smaller but connected to an intermediate beam anchored on each side of the pot.

FIG. 4 describes the design principle of the present invention. The removable beam 8A is indeed similar to 8 on FIG. 2 but much smaller. The arms and rolls are fixed on this movable beam.

A new intermediate beam 13 is implemented and fixed in the concrete at respective supports 9 and 10. Beam can be dismantled from the line but only in case of necessity for special maintenance issues.

When the rolls 1 and 3 have to be replaced, an operation that occurs every 1 to 6 weeks depending on the line operation, only the removable beam 8A with its arms and rolls attached is removed.

Particular devices are used to connect safely and quickly the removable beam 8A to the intermediate beam 13. These devices comprise bolts, air cylinders or similar devices.

The intermediate beam 13 can be tiltable, translatable or totally fixed, depending on the global technical solution selected. When it is tiltable—around an axis along its length or translatable, it serves to adjust the position of the rolls in the pot.

When the weight of prior art design is compared to the weight of the invention design, a ratio of 3/1 is obtained. Regarding the total length, the ratio is in the range of 2/1. The new device is then much smaller and lighter.

INDUSTRIAL APPLICATION

The system has being used on different hot-dip galvanization lines with a line speed up to 180 m/min and a strip thickness from 0.4 up to 4 mm and width up to 2 meters.

Figure 3:
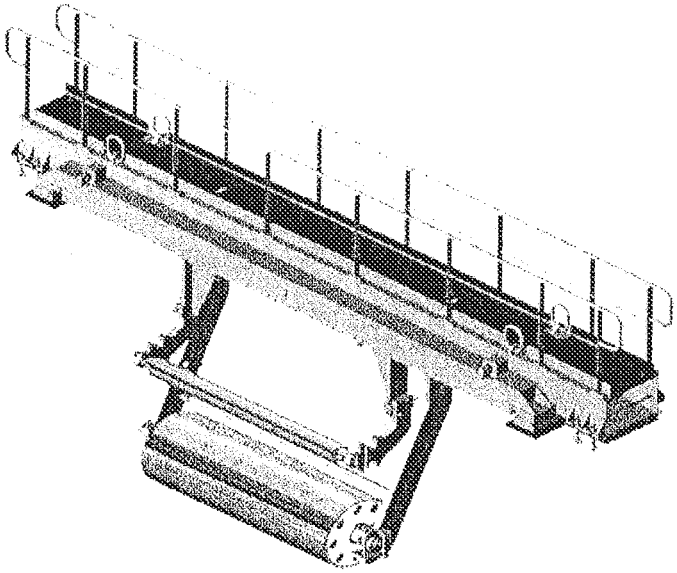
FIG.3 PRIOR ART
FIG. 3 is a typical perspective view of a supporting beam (metal frame) and of the sink and additional rolls, according prior art.

The 2-pot rolls or 3-pot rolls configuration have been designed and tested. Results have shown that the device was easy to operate, safe for operators and is reaching the target of lower weight. For example, when comparing the present invention (FIG. 5) with the classical device (FIG. 2 and FIG. 3), it turns out that the total length is reduced from about 7 meters to only 3.5 meters, a ratio of about 2. Similarly, the weight is reduced for 9.3 tons to only 6.3 ton with the same roll diameter of typically 800 mm and same weight.

LIST OF REFERENCE SYMBOLS

1 sink roll
2 additional roll
3 additional roll
4 liquid metal pot
5 top roll
6 wiping nozzle
7 ceramic liner
8, 8A metal frame
9 support anchored in concrete
10 support anchored in concrete
11 metal strip
13 intermediate beam
16 arm
17 furnace

The invention claimed is:

1. An installation for the hot-dip coating of a metal strip (11) with a liquid metal, comprising a pot (4) containing a bath of liquid metal, an immersed sink roll (1) for deflecting the strip entering the bath to a vertical exit path and at least one additional roll (2, 3) for controlling the strip flatness, the axes of said sink and additional rolls (1, 2, 3) being supported by arms (16) connected to a main metal frame (8, 8A) itself connected to a base on each side of the pot by means of supports (9, 10), characterised in that the metal frame is a double beam made of a removable beam (8A) supporting the rolls (1, 2, 3) connected to an intermediate beam (13) itself anchored to the base by the supports (9, 10) and in that the removable beam (8A) is smaller in length than the intermediate beam (13) extending over the opening of the pot.

2. The installation according to claim 1, characterised in that the intermediate beam (13) is permanent.

3. The installation according to claim 1, characterised in that the intermediate beam (13) is removable for special maintenance purposes.

4. The installation according to claim 1, characterised in that the removable beam (8A) makes a single part with the arms (16) and the rolls (1, 2, 3).

5. The installation according to claim 1, characterised in that the base is a concrete base.

* * * * *